United States Patent [19]

Sadowski

[11] 4,064,318

[45] Dec. 20, 1977

[54] CONCENTRATED POLYMER EMULSION AS A CLEANER AND LUBRICANT

[75] Inventor: Anthony J. Sadowski, Chicago, Ill.

[73] Assignee: Nalco Chemical Company, Oak Brook, Ill.

[21] Appl. No.: 662,093

[22] Filed: Feb. 27, 1976

Related U.S. Application Data

[63] Continuation-in-part of Ser. No. 420,195, Nov. 28, 1973, abandoned.

[51] Int. Cl.[2] ..... F16N 15/00

[52] U.S. Cl. ..... 428/543; 134/22 C

[58] Field of Search ..... 134/22 C; 210/54, 58; 252/106, 554, 153, 546, 170, 172, DIG. 2, DIG. 15, 156, 9, 11, 59; 260/29.6 H, 29.6 HN, 29.6 SQ; 137/15; 428/2, 543

[56] References Cited

U.S. PATENT DOCUMENTS

| | | | |
|---|---|---|---|
| 374,008 | 11/1887 | Schuyler | 137/15 |
| 3,085,916 | 4/1963 | Zimmie et al. | 210/58 X |
| 3,122,203 | 2/1964 | Hawkins | 166/305 R |
| 3,284,393 | 11/1966 | Vanderhoff et al. | 260/29.6 R |
| 3,503,890 | 3/1970 | Davisson et al. | 252/156 X |
| 3,523,826 | 8/1970 | Lissant | 134/22 C |
| 3,624,019 | 11/1971 | Anderson et al. | 260/29.6 SQ X |
| 3,826,771 | 7/1974 | Anderson et al. | 260/29.6 H |

*Primary Examiner*—S. Leon Bashore
*Assistant Examiner*—Marc L. Caroff
*Attorney, Agent, or Firm*—John G. Premo; John S. Roberts

[57] ABSTRACT

Gravity flow in generally vertical stack lines in buildings and dwellings is improved by the application at the top of the drain of a concentrate of a water-soluble vinyl addition polymer, said concentrate being a water-in-oil emulsion which has a water-soluble vinyl addition polymer concentration between 20 and 50% by weight based on the total emulsion which exhibits unusual stability properties. The invention also applies to lubrication of garbage prior to its entry into garbage disposals.

2 Claims, 2 Drawing Figures

CONCENTRATED POLYMER EMULSION AS A CLEANER AND LUBRICANT

Figure 1:
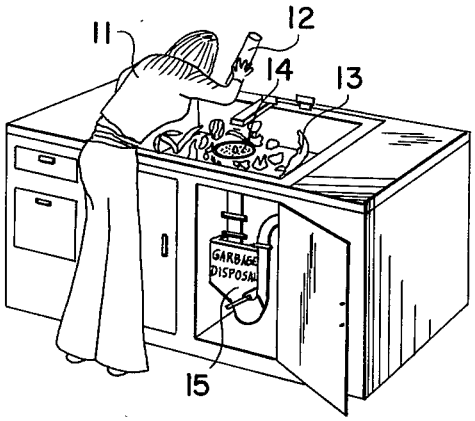

This application is a continuation in part of Ser. No. 420,195 filed Nov. 28, 1973 (now abandoned).

INTRODUCTION

This invention relates to the improvement of flow in generally vertical and gravity-fed stacks and associated sewage removal lines by reducing the accumulation of solids in the lines by the injection of a concentrated oil-in-water emulsion of a water-soluble vinyl addition polymer which is introduced at the top or open end of the stack or main vertical line and lubricates or cleans by gravity action.

This invention contains related subject matter to U.S. Pat. No. 3,826,771 Anderson et al. and U.S. Pat. No. 3,624,019 Anderson et al.

As one might expect, the flow in the stack may be reduced or almost completely impeded by the accumulation of solids from drain lines. The solids which accumulate in a drain line are of a wide variety. Apartments, office buildings, hospitals, high-rises, etc., all have the serious drain plugging problem due to solid buildup. This results from garbage and other foreign matter being flushed into the sink, tub, and toilet drains. This may include, but is not limited to, hair, food, grease, sand, silt, metals, paper, mud, corrosion, and mixtures thereof.

In a typical apartment or building refuse removal arrangement, there are one or more vertical stacks which are main vertical lines open at the top usually on the roof or uppermost point of the interconnected drain set ups. A stack runs vertically as a drain line and at the various levels of the building adds drain and sewage sloping feeder lines which feed by gravity into the main vertical stack line usually underground to the main sewage removal line.

The preferred point of application in this invention for the concentrate is into the opening of the stack to assist in removing solid accumulation from this key area. An alternate point of application is to precoat garbage with the concentrate prior to feeding the garbage into a mechanical kitchen disposal and this relieves accumulation in the trap area at the entrance to or the beginning of a drain line.

A typical commercial and prior art product used for the solution of both drain and sewage lines is an inhibited sulfuric acid cleaner. Its particular drawbacks include the safety in handling, potential drain line corrosion, and sulfate scale buildup in the drain lines. It would be quite advantageous to provide a new method for improving the flow in stack and associated sewer removal lines by utilization of the present process. It has been found that by injection a concentrated water-in-oil emulsion of a water-soluble vinyl addition polymer, the accumulation of solids in the stack and sewer line may be reduced and, in addition, the periodic use of such an emulsion will serve to prevent future accumulation of solids in sewer lines. The concentrate is utilized in an optimum range of about 500 ppm calculated as additive reaching the sewage main line, with operable ranges of 250–1,000 ppm.

PRIOR ART

The prior art teaches a method of removing and preventing accumulation of solids in cooling systems as disclosed in U.S. Pat. No. 3,085,916 Zimmie et al. Zimmie U.S. Pat. No. 3,085,916 is believed to be in a different technical art, since its sole application is to cooling systems to prevent accumulations in such units as water towers, cooling jackets, etc., and this inventive thrust is accentuated in the first two columns of Zimmie. It is further noted with reference to the above Zimmie U.S. Pat. No. 3,085,916 patent that the claims of the patent have restrictions concerning velocity to carry the treated accumulation of water flowing through the system and are restricted entirely to water-cooled industrial heat exchange and cooling systems.

An additional patent for the method of removing silt from tanks is as disclosed in U.S. Pat. No. 3,080,264 Zimmie et al.

These methods in the above two Zimmie patents disclosed the use of water-soluble polyelectrolyte polymers for removing and preventing accumulations in cooling systems and ballast tanks. The methods taught in these two references have not been found to be satisfactory for improving the flow in drain lines.

Additionally, U.S. Pat. No. 3,122,203 Hawkins discloses a circulating medium and a high molecular weight polymer introduced into a well to remove mud and sediment.

Also, 3,523,826 Lissant teaches a method of cleaning piping systems using a pseudoplastic fluid which may, at column 4, have an additive which is a biocide. The examples as well as the claims of this patent seem clearly to be distinguished from the present invention.

The compositions of this invention are utilized in concentrate or neat form and assist in removing of solids buildup, provide lubrication to the drain lines to deter future plugging problems, which results in faster drainage due to the lubrication effect of the polymer. The compositions also can be packaged in small, easily transportable containers to provide a convenient means of minimizing the problems listed in the prior art.

THE INVENTION

This invention is directed to a method of improving the flow in vertical drain lines and associated sewer lines by reducing the accumulation of solids in said lines. This method is effected by adding into the stack at the top of the drain line a neat or concentrated solution of a water-soluble vinyl addition polymer, which is a stable water-in-oil emulsion. The stable water-in-oil emulsion comprises (1) an aqueous phase and (2) a hydrophobic liquid containing a water-in-oil emulsifying agent.

The polymer containing emulsion of this invention is comprised on an aqueous phase ranging from between 30 and 95 percent by weight of the emulsion. The aqueous phase is defined as the sum of the polymer or copolymer and the water present in the composition. The preferred range of aqueous phase is between 70 and 90 percent by weight of the emulsion. The most preferred range is between 70 and 80 percent by weight of the emulsion.

The polymer concentration of the emulsion ranges between 20–50 percent by weight, said polymer having a particle size within the range of 2 millimicrons to 5 microns. A preferred range is between 25 and 40 percent by weight of the emulsion. The most preferred range is between 25 and 35 percent by weight of the emulsion.

As seen, based on the weight of the aqueous phase and the percent polymer contained in the aqueous phase, the polymer containing emulsion may contain from 20–85% by weight water.

This invention is directed to a stable water-in-oil polymer emulsion which contains dispersed therein finely divided particles of water-soluble vinyl addition polymers in the concentration of at least 10% based on emulsion. This can be termed a polymer-containing emulsion.

A unique aspect of the polymer emulsion is its stability. From a commercial standpoint it is beneficial that the polymer emulsion be stable, yet at the same time contain relatively large amounts of polymer. One method of assuring that the polymers do not precipitate when dispersed in the emulsion is that the polymer size of the particle be as small as possible. Thus, polymers dispersed in the emulsion are quite stable when the particle size is within the range of 2 millimicrons up to about 5 microns. The preferred particle size is within the range 5 millimicrons to 3 microns.

The primary feature of this polymer-containing emulsion is that it remains stable with passage of time. The stability which this composition exhibits as defined above is the maintenance of the dispersion of the polymer particles throughout the emulsion for a period of at least three weeks at which time the dispersion can be reformed with only slight agitation.

The term concentrate or neat with reference to the polymer emulsion in this invention means an emulsion having a polymer concentration of between 20–25% by weight of the emulsion.

The polymers most commonly used in many industrial applications are acrylamide polymers which include polyacrylamide and its water-soluble copolymeric derivatives such as, for instance, acrylic acid, methacrylic acid, maleic anhydride, acrylonitrile, and styrene. The copolymers contain from about 5 to 95 percent by weight of acrylamide.

Other water-soluble vinyl polymers are described in detail in the following U.S. Pat. Nos.: 3,418,237; 3,259,570; and 3,171,805 which are incorporated herein by reference. In examining the disclosures of these patents, it will be seen that the water-soluble polymers may be either cationic or anionic and, in some instances, the ionic charges are sufficiently slight so that the polymers may be considered nonionic. For example, water-soluble polymers and copolymers of allyl, diallyl amines or dimethylaminoethylmethacrylate are cationic. Polymers such as polyvinyl alcohol are nonionic and polymers such as polyacrylic acid or polystyrene sulfonates are anionic. All of these polymers may be used in the practice of this invention.

The molecular weight of the polymers described above may vary over a wide range; e.g., 10,000 to 25,000,000. The preferred polymer has a molecular weight in excess of 1,000,000.

The organic or oil phase is comprised of an inert hydrophobic liquid containing a water-in-oil emulsifying agent having a concentration between 0.1 and 21% by weight of the emulsion. The hydrophobic liquid comprises between 5 and 70 percent by weight of the emulsion. The preferred range is between 5 and 40 percent by weight of the emulsion. The most preferred range is between 20 and 30 percent by weight of the emulsion.

The oils used in preparing these emulsions may be selected from a large group of aliphatic organic liquids which include liquid hydrocarbons and substituted liquid hydrocarbons. A preferred group of organic liquids are alkanes, including both straight chain and branch chain varieties. A particularly useful oil from the standpoint of its physical and chemical properties is the branch-chain isoparaffinic solvent sold by Humble Oil and Refinery Company under the trandename "ISOPAR M." Typical specifications of this narrow-cut isoparaffinic solvent are set forth below in Table I.

TABLE I

| Specification Properties | Minimum | Maximum | Test Method |
|---|---|---|---|
| Gravity, API at 60/60° F | 48.0 | 51.0 | ASTM D 287 |
| Color, Saybolt | 30 | — | ASTM D 156 |
| Aniline Point, ° F | 185 | — | ASTM D 611 |
| Sulfur, ppm | — | 10 | ASTM D 1266[1] |
| Distillation, ° F | | | |
| IBP | 400 | 410 | |
| Dry Point | — | 495 | |
| Flash Point, ° F[2] | 160 | — | ASTM D 93 |

[1]Nephelometric mod.
[2]Pensky-Martens Closed Cup

Any conventional water-in-oil emulsifying agent can be used such as sorbitan monostearate, sorbitan monooleate, and the so-called low HLB materials which are all documented in the literature and are summarized in the Atlas HLB Surfactant Selector. Although the mentioned emulsifiers are used in producing good water-in-oil emulsions, other surfactants may be used as long as they are capable of producing these emulsions. The water-in-oil emulsifying agent is presented in amounts ranging between 0.1 and 21 percent by weight of the emulsion. The preferred range is between 1.0 and 15 percent by weight of the emulsion. The most preferred range is between 1.2 and 10 percent by weight of the emulsion.

The water-in-oil polymer containing emulsions of this invention are prepared by the techniques used in U.S. Pat. No. 3,284,393 Vanderhoff, which is incorporated herein by reference. Basically, the emulsions are prepared by:

A. Using as a reaction mixture:

1. water which contains dissolved therein a water-soluble vinyl addition monomer thereby producing a monomer phase, having a concentration of from 30 to 95 percent by weight of the emulsion
2. an inert hydrophobic liquid ranging between 5 and 70 percent by weight of the emulsion containing a water-in-oil emulsifying agent in a concentration of 0.1 to 21% by weight of the emulsion
3. a free radical initiator whereby a water-in-oil emulsion is formed B. Heating the emulsion under free radical conditions to polymerize the water-soluble vinyl addition monomer containing emulsion thereby producing a stable water-in-oil emulsion which contains dispersed therein finely divided particles of a water-soluble vinyl addition polymer.

THEORY OF ACTION OF THE METHOD OF THE PRESENT INVENTION

It is postulated that the neat or concentrate water-in-oil emulsion which is added at the top of the stack area of the drain and proceeds by gravity downward finally to the sewage line picks up moisture and water in transit and inverts to an oil-in-water type emulsion. This inversion is consonant with the inverse technique as described in U.S. Pat. No. 3,624,019 Anderson et al, which is incorporated here by reference. The addition of a surfactant in the concentrate or in a separate package assists the emulsion in rapid inverse on contact with a substantial amount of water. Preferred surfactants useful inverting the polymeric emulsion are also described in U.S. Pat. No. 3,624,019 above.

It is often advantageous to add to the polymer emulsion from 0.1–5% by weight of sodium sulfate. In addition, it is often in order to suppress biological growth; from 0.01 to 1.0% by weight of a biocidal composition may also be added either with or without the sodium sulfate addition. Any of the commercially available biocides may be added to the emulsion without hindering product stability or quality. Preferably the polymer emulsion will contain both the sodium sulfate and the biocidal composition.

In addition to acting as a drain cleaner, the compositions of the incident invention also act as a lubricant. These compositions are useful in industrial, commercial, institutional, and consumer type uses.

Figure 2:
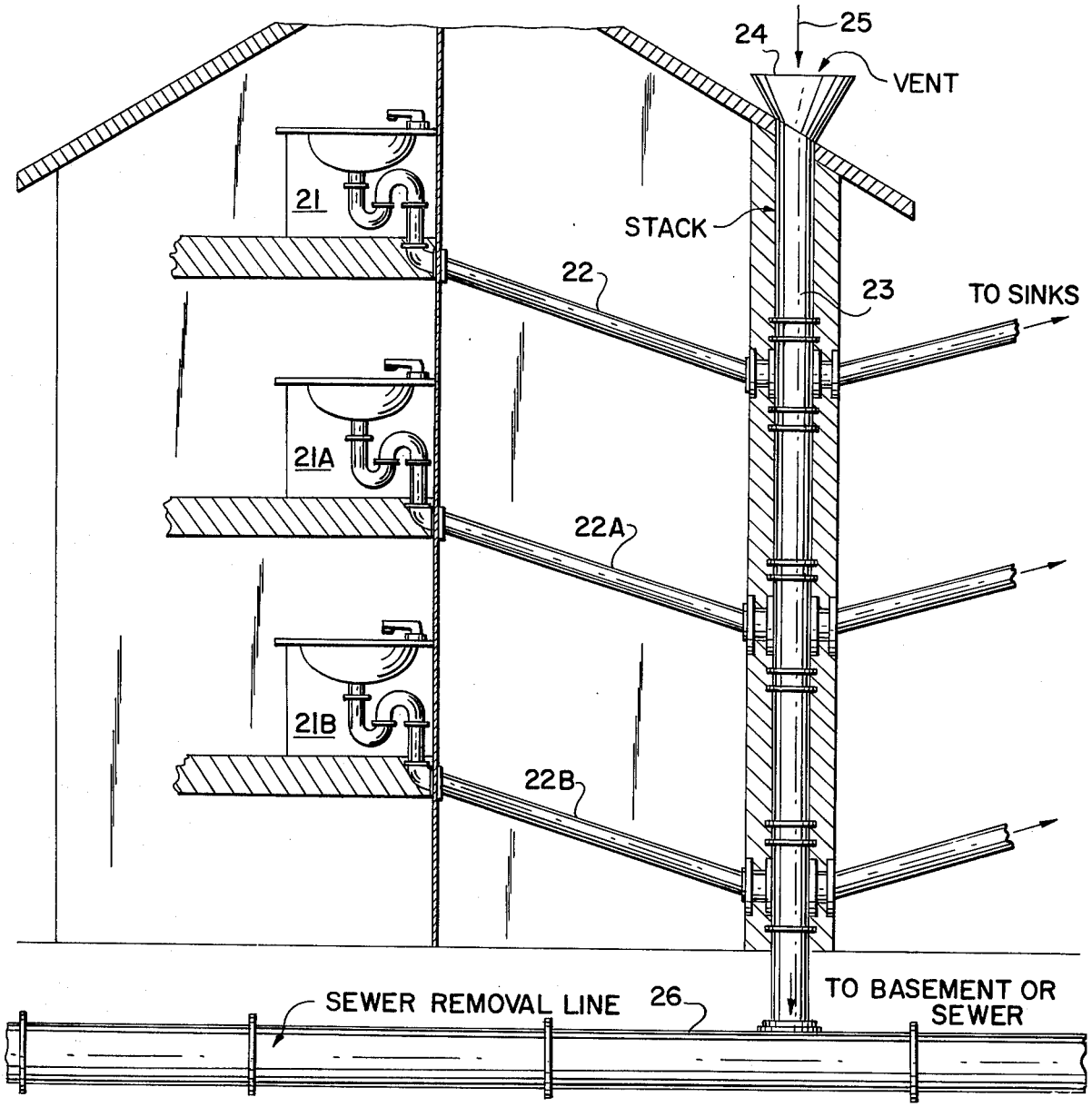

In the description of the invention,

FIG. 1 and FIG. 2 are diagrammatic views.

FIG. 1 shows a typical housewife 11 with an open container of drain lubricant 12 coating garbage 13 at the input of a drain 14 leading to a mechanical garbage disposal 15.

FIG. 2 shows 21, 21A, and 21B as a series of kitchen sinks on successive levels of an apartment building leading to drain lines 22, 22A, 22B which angle downwardly and feed into stack line 23 with associated stack vent 24. Arrow 25 indicates the point of application of the drain lubricant from an exposed roof area at the top of the stack. 26 shows the main sewage removal line connected to stack line 23.

The following examples illustrate the present invention.

EXAMPLE 1

Preparation of a Polymer Emulsion

ISOPAR M: 27.6 grams
Sorbitan Monostearate: 1.65 grams
Water: 40.20 grams
Acrylamide: 34.51 grams
Methacrylic Acid: 2.31 grams
Sodium Hydroxide: 2.29 grams
2,2'azobis (isobutyronitrile): 0.07 grams.

The sorbitan monostearate was dissolved in the ISOPAR M and the resulting solution was poured into a two-liter glass reactor fitted with a stirrer, thermometer, and nitrogen purge. The monomer solution was prepared by dissolving the acrylamide and methacrylic acid in water. The pH of the monomer solution was adjusted to 8.5 with sodium hydroxide. The monomer solution was added to the organic phase with rapid agitation. The reactor was purged for 30 minutes after which time the 2,2'azobis (isobutyronitrile) dissolved in acetone was added to the mixture. The emulsion was heated to 60° C with agitation. The reaction proceeded for 2 ½ hours at which time it had reached completion. The resulting product was a stable emulsion.

EXAMPLE 2

Acrylamide-acrylic Acid Emulsion Recipe

ISOPAR M: 28.10 grams
Sorbitan Monostearate: 1.85 grams
Water: 40.00 grams
Acrylamide: 33.90 grams
Acrylic Acid: 2.40 grams
Sodium Hydroxide: 2.30 grams
2,2'azobis (isobutyronitrile): 0.07 grams.

As in Example 1, the sorbitan monostearate was dissolved in the ISOPAR M and the resulting solution was poured into a 2-liter glass reactor fitted with a stirrer, thermometer, and nitrogen purge. The monomer solution was prepared by dissolving the acrylamide and acrylic acid in water. The pH of the monomer solution was added to the organic phase with rapid agitation. The reactor was purged for 30 minutes after which time the 2,2' azobis (isobutyronitrile) dissloved in acetone was added to the mixture. The emulsion was heated to 60° C with agitation. The reaction proceeded for 2 ½ hours at which time it had reached completion. The resulting product was a stable emulsion.

EXAMPLE 3

Dimethylaminoethyl Methacrylate Emulsion Recipe

ISOPAR M: 27.60 grams
Sorbitan Monostearate: 1.65 grams
Water: 40.20 grams
Dimethylaminoethyl methacrylate (DMAEM): 38.82 grams
Sodium Hydroxide: 2.29 grams
2,2'azobis (isobutyronitrile): 0.07 grams.

The sorbitan monostearate was dissolved in the ISOPAR M and the resulting solution was poured into a 2-liter glass reactor fitted with a stirrer, thermometer, and nitrogen purge. The monomer solution was prepared by dissolving the DMAEM in water. The pH in monomer solution was adjusted to 8.3 with sodium hydroxide. The monomer solution was added to the organic phase with rapid agitation. The reactor was purged for 30 minutes after which time the 2,2'azobis (isobutyronitrile) dissolved in acetone was added to the mixture. The emulsion was heated to 60° C with agitation. The reaction proceeded for 5 hours at which time it had reached completion. The resulting product was a stable emulsion.

EXAMPLE 4

Polystyrene Sulfonate Emulsion Recipe

ISOPAR M: 27.60 grams
Sorbitan Monostearate: 1.65 grams
Water: 40.20 grams
Styrene Sulfonate: 36.80 grams
Sodium Hydroxide: 2.29 grams
2,2'azobis (isobutyronitrile): 0.07 grams.

This reaction was performed using the identical procedure as in the previous examples. The reaction proceeded for eight hours at which time it had reached completion.

EXAMPLE 5

670 grams of an emulsion was prepared according to the procedure of Example 2 and was packaged in a rolled metal inner-coated fiberboard container and was added to the drain stack of a four-story apartment building in increments over a period of three hours. Incorporated in the container was a small amount (3 g) of Triton-X-114, a commercially available water-soluble surfactant (octyl phenol reacted with ethylene oxide). Tests made at the sewer removal line H of the apartment house later showed an increase of solids removal above normal flow ranging from a multiple of 28 to a multiple of 16. Additional tests showed that comparable effective sewage cleaning action was achieved where 20 g of sodium sulfate and 5–10 g of a suitable biocide such as hexachlorophene or a quaternary compound exemplified by trimethyl benzyl ammonium chloride were added.

I claim:

1. The method of conditioning garbage prior to treatment of said garbage with a garbage disposal unit which comprises applying to said garbage before entry into said garbage disposal an effective lubricating amount of a concentrate water-in-oil emulsion consisting of:

A. An aqueous phase ranging between 30 and 95% by weight of the emulsion which contains a water-soluble vinyl addition polymer having a concentration between 20 and 50% by weight of the emulsion, said polymer having a particle size within the range of 2 millimicrons to 5 microns B. An inert hydrophobic liquid hydrocarbon phase ranging between 5 and 70% by weight of the emulsion containing a water-in-oil emulsifying agent having a concentration between 0.1 and 21% by weight of the emulsion.

2. The method of alleviating accumulation of refuse in the trap area leading to an exit drain line in a multistory house or apartment which comprises coating said refuse with a concentrate water-in-oil emulsion as a pretreatment of the refuse prior to feeding said refuse as input to a garbage disposal unit, said concentrate water-in-oil emulsion consisting of:

A. An aqueous phase ranging between 30 and 95% by weight of the emulsion which contains a water-soluble vinyl addition polymer having a concentration between 20 and 50% by weight of the emulsion, said polymer having a particle size within the range of 2 millimicrons to 5 microns B. An inert hydrophobic liquid hydrocarbon phase ranging between 5 and 70% by weight of the emulsion containing a water-in-oil emulsifying agent having a concentration between 0.1 and 21% by weight of the emulsion.

* * * * *